US005461887A

United States Patent [19]

VonPless

[11] Patent Number: 5,461,887

[45] Date of Patent: Oct. 31, 1995

[54] APPARATUS FOR PRE-TREATING SOILED FABRIC ARTICLES PRIOR TO LAUNDERING

[76] Inventor: Douglas J. VonPless, 7948 Orion Path, Liverpool, N.Y. 13090

[21] Appl. No.: 325,066

[22] Filed: Oct. 19, 1994

Related U.S. Application Data

[62] Division of Ser. No. 92,472, Jul. 16, 1993, Pat. No. 5,381, 574.

[51] Int. Cl.[6] ..... D06B 1/02; D06B 17/00

[52] U.S. Cl. ..... 68/18 F; 68/205 R

[58] Field of Search ..... 68/5 C, 17 R, 68/205 R, 6, 12.12, 205 D, 240, 18 F; 134/95.3, 99.1, 99.2, 103.2, 107, 199, 200; 422/292, 300; 8/149.2, 158

[56] References Cited

U.S. PATENT DOCUMENTS

| | | | |
|---|---|---|---|
| 2,176,140 | 10/1939 | Lofgren | 21/127 |
| 2,499,064 | 2/1950 | Hartley | 68/6 |
| 2,699,661 | 1/1955 | Olson | 68/205 |
| 2,704,082 | 3/1955 | Jackson | 134/95.3 |
| 2,741,113 | 4/1956 | Norkus | 68/205 |
| 3,611,456 | 10/1971 | Hildebrandt | 8/149.1 |
| 3,660,013 | 5/1972 | Payet et al. | 8/116.4 |
| 3,927,539 | 12/1975 | Harkison | 68/3 R |
| 4,008,930 | 2/1977 | Swainson | 312/31.1 |
| 4,068,575 | 1/1978 | Difley et al. | 100/45 |
| 4,738,792 | 4/1988 | Ertle | 252/118 |
| 4,785,836 | 11/1988 | Yamamoto | 134/200 X |
| 5,220,933 | 6/1993 | Albers | 134/200 X |

*Primary Examiner*—Philip R. Coe
*Attorney, Agent, or Firm*—Vickers, Daniels & Young

[57] ABSTRACT

A method and container are provided for pre-treating soiled fabrics, such as clothes, to enhance cleaning thereof upon subsequent laundering such as in a domestic washing machine. The soiled fabrics are moisturized and stored in the container which is sealed airtight to retain the moisture in the fabrics. Preferably, the soiled fabrics are moisturized to provide a minimum moisture content of about 7% based on the weight thereof.

19 Claims, 4 Drawing Sheets

APPARATUS FOR PRE-TREATING SOILED FABRIC ARTICLES PRIOR TO LAUNDERING

This is a division, of application Ser. No. 092,472 filed Jul. 16, 1993, and now U.S. Pat. No. 5,381,574.

BACKGROUND OF THE INVENTION

This invention relates to the art of aqueous laundering of soiled fabric articles and, more particularly, to a method of pre-treating such articles to enhance the cleaning thereof upon subsequent laundering and to apparatus for achieving such purpose.

It is of course well known that fabric articles such as clothing, towels, bed sheets and the like are soiled by wearing or use thereof. Further, it is common practice to set aside such soiled fabrics until such time as they may be laundered in a washing machine designed for such purpose using a commercially available detergent alone or in combination with additional laundering aides such as fabric softeners and bleaches. In this fashion soiled articles are restored, to as great an extent as possible, to the condition possessed before use. However, it is also well recognized that restoration of fabrics by this method is typically incomplete and, in particular cases, unacceptable. Many approaches have been taken to address the short comings of the results achieved by conventional laundering, both within the process itself and external to it. Internally, advancements in both washing machine design and operation, as well as improvements in formulations of cleaning agents and additives take place on a continuing basis. In addition to these advances, "pre-soak" cycles on washing machines, in which soiled articles are allowed to stand in an aqueous bath for an extended period, afford a launderer yet another tool to improve cleaning performance. External to the washing process itself, advancements in fabric compositions, structural designs, and "finishes" applied to fabrics often take into consideration, in whole or in part, the desirability of improved "washability". In addition, other external approaches to improve cleaning performance of soiled fabric articles are available. These include relatively simple techniques such as pouring laundry detergent directly on stains just prior to placement in the washing machine and various "home remedies" applied to a stain at the time of its occurrence. Yet another external approach to improved cleaning consists of the application of one of several commercial "pre-spotting" compositions designed for such purpose, either immediately before laundering, immediately after soiling, or at some point in between.

Taken together, this wide array of equipment, cleaning agents and pre-treating techniques have proved adequate in maintaining the pre-eminence of conventional laundry practice while failing to fully satisfy the need for improved cleaning performance as evidenced by the high level of developmental activity which continues in the laundering field. No particular washing machine design has proven to be optimal. No single commercial laundry detergent or combination of detergent and additives has been found capable of cleaning all soil types encountered in a typical wash load. Pre-soak cycles on washing machines are not frequently used due primarily to time constraints. Pre-spotting products and techniques apply only to the worst of stains, and then only if the launderer is highly conscientious. New fabrics and fabric finishes have been unable to resist adherence by persistent soils.

Soiled fabrics which have been set aside for laundering are commonly placed in a hamper designed for this purpose. Hampers are generally designed to "breathe" or allow air exchange so as to prevent biological growth on the fabric articles during storage. While awaiting laundering, stains and soils undergo a progressive tendency to "set", or become more difficult to remove. Dehydration of water-borne soils, whether soluble or suspended, often creates chemical structures which become increasingly difficult to rehydrate. Unsaturated fatty substances, such as those contained in sebum, food particles and unsaturated oils, undergo air oxidation to produce products which adhere much more tenaciously to fabric fibers. Mobile organic soils continue to spread and penetrate fibers over time. The end result upon subsequent laundering of the fabrics so stored is a less than desirable efficiency with respect to removal of such contaminants.

SUMMARY OF THE INVENTION

In accordance with the present invention, there is provided a method and apparatus by which soiled fabrics such as clothing, towels and the like can be pre-treated in bulk over a period of time prior to laundering to enhance removal of contaminants during the laundering process. In this respect, the method and apparatus minimizes or precludes the problems posed by soils which heretofore resulted from dehydration, air oxidation and the like due to their residence time prior to laundering. More particularly in accordance with the invention, a quantity of soiled fabric articles is placed in an essentially airtight container such that a conditioning agent or agents may be introduced and held within. The container is then closed, whereby the fabrics are conditioned and the interior of the container retains such conditioners so as to prevent dehydration of the fabric articles and, indeed to promote hydration and conditioning of such articles, thus promoting preparation of the soils thereon for easier removal during a subsequent laundering operation. Any number of conditioning agents can be employed for the foregoing purpose from the simplistic example of plain water, to complex blends of cleaning ingredients found in commercially available liquid laundry detergents, detergent solutions or slurries made by mixing water or other liquid with dry, commercially available laundry detergents, liquid bleaching materials such as chlorine bleach, hydrogen peroxide solutions and the like, and combinations of such materials.

Such conditioners may be introduced into the container and disbursed onto fabric articles therein such as by pouring, or spraying, either as a cold mist or in the form of vapor. Further, the conditioner can be manually sprayed into the container such as through the use of a hand operated spray dispenser or steam dispenser, or through the use of mechanical dispensing devices associated with the container and either manually operated or operated in response to placing the cover on the container.

Preferably, for a given quantity of soiled fabric articles placed in the container, conditioner is introduced into the container to provide a minimum moisture content of about 7% by weight of fabric thereof. Conditioner can be introduced into the container to provide moisture in excess of 7% but, as will become apparent hereinafter, the cleaning efficiency achieved in accordance with the invention results from maintaining moisture in the fabrics during hamper storage and is not dependent on the quantity of moisture. Moreover, cleaning efficiency does not improve in proportion to the moisture content. At the same time, however, it has been found that, with the liquids used to provide the moisture, cleaning efficiency is noticeably improved if the liquid contains a laundry detergent.

In accordance with the foregoing, it may be regarded as a primary object of the present invention to provide apparatus for creating an environment for the safe and effective pre-treatment of soiled laundry and which is general in scope and convenient in application and compatible with conventional laundering methods.

It is a further object of the invention to provide apparatus as aforementioned, to utilize the time elapsed between storage of soiled fabric articles and laundering of same for the purpose of conditioning the articles as a whole, including the soils thereon, for more efficacious cleaning results during subsequent laundering.

It is yet a further object of the present invention to provide apparatus for pre-treating soiled fabrics to enhance cleaning thereof upon subsequent laundering.

Another object is the provision of apparatus of the foregoing character whereby soiled fabrics are maintained conditioned in a substantially air tight container prior to laundering so as to improve the cleaning efficiency thereof upon laundering relative to soiled fabrics which have not been so pre-treated.

A further object is the provision of a storage container or hamper for soiled fabrics which is substantially air tight when closed and provided with a liquid holding and dispensing arrangement which facilitates introducing liquid into the container prior to or in conjunction with closing the container cover.

BRIEF DESCRIPTION OF THE DRAWINGS

The foregoing objects, and others, will in part be obvious and in part pointed out more fully hereinafter in conjunction with the written description of embodiments of the invention including an embodiment of a hamper illustrated in the accompanying drawings in which.

DESCRIPTION OF PREFERRED EMBODIMENTS

Figure 1:
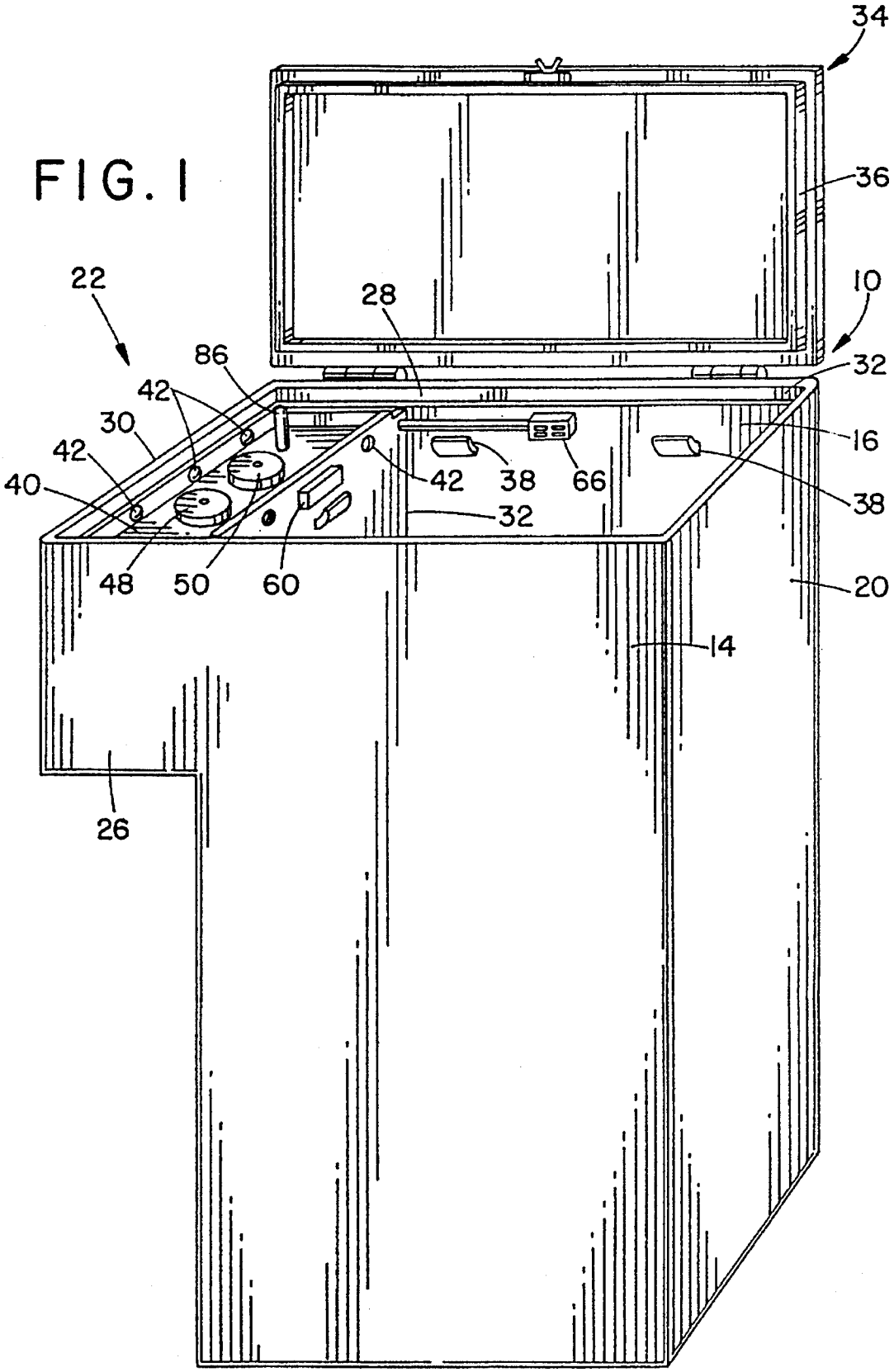
FIG. 1 is a perspective view of a hamper in accordance with the present invention having an arrangement for dispensing liquid into the interior of the hamper.
Figure 2:
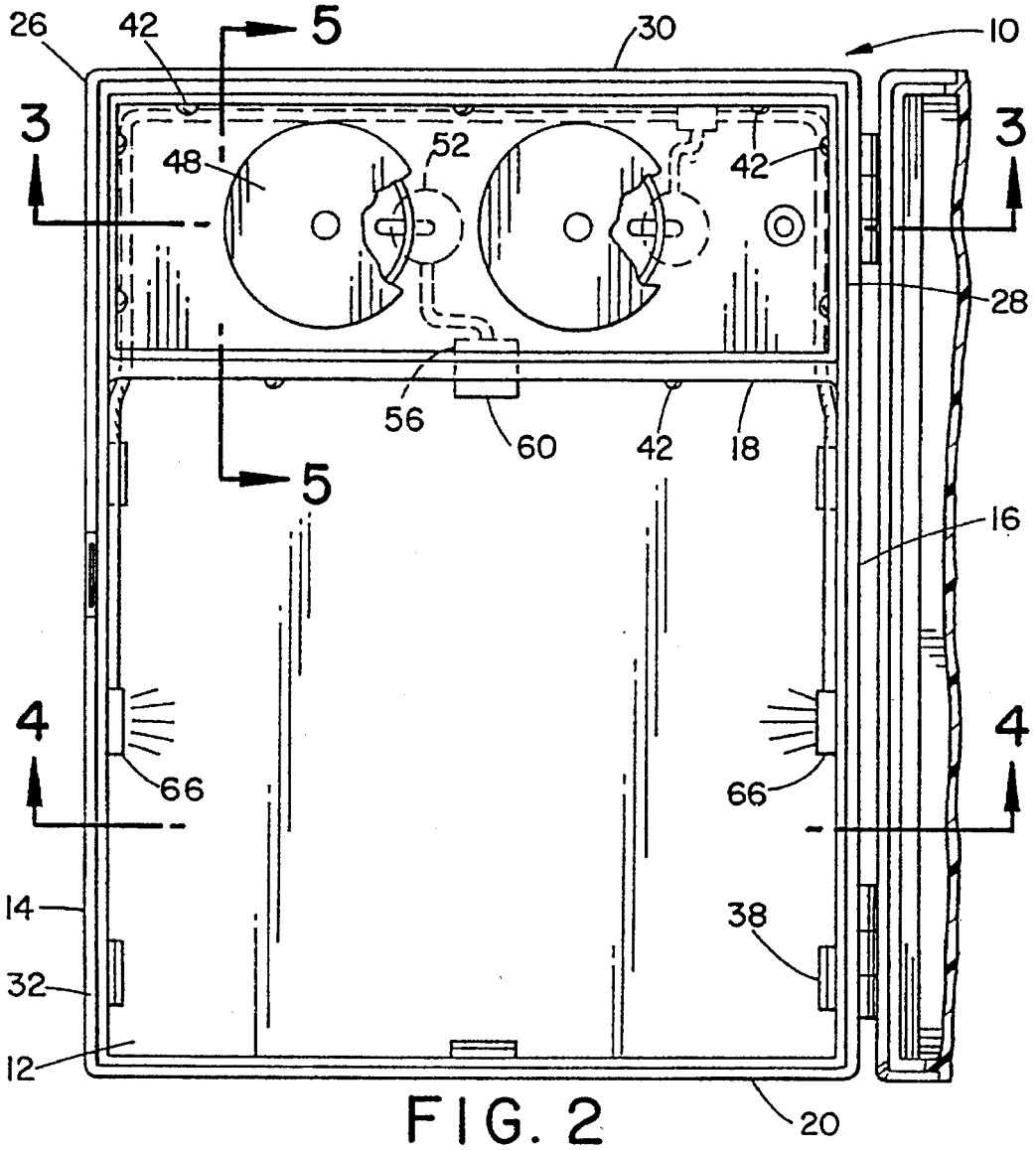
FIG. 2 is a plan view of the interior of the hamper.
Figure 5:
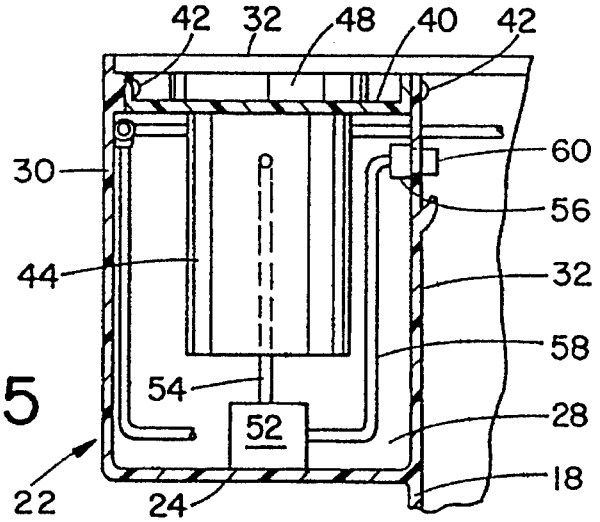
FIG. 5 is a sectional elevation view of the holding and dispensing arrangement taken along line 5—5 in FIG. 2; and, FIG. 6 is a schematic illustration of circuitry for controlling the dispensing of liquid into the hamper.
Figure 3:
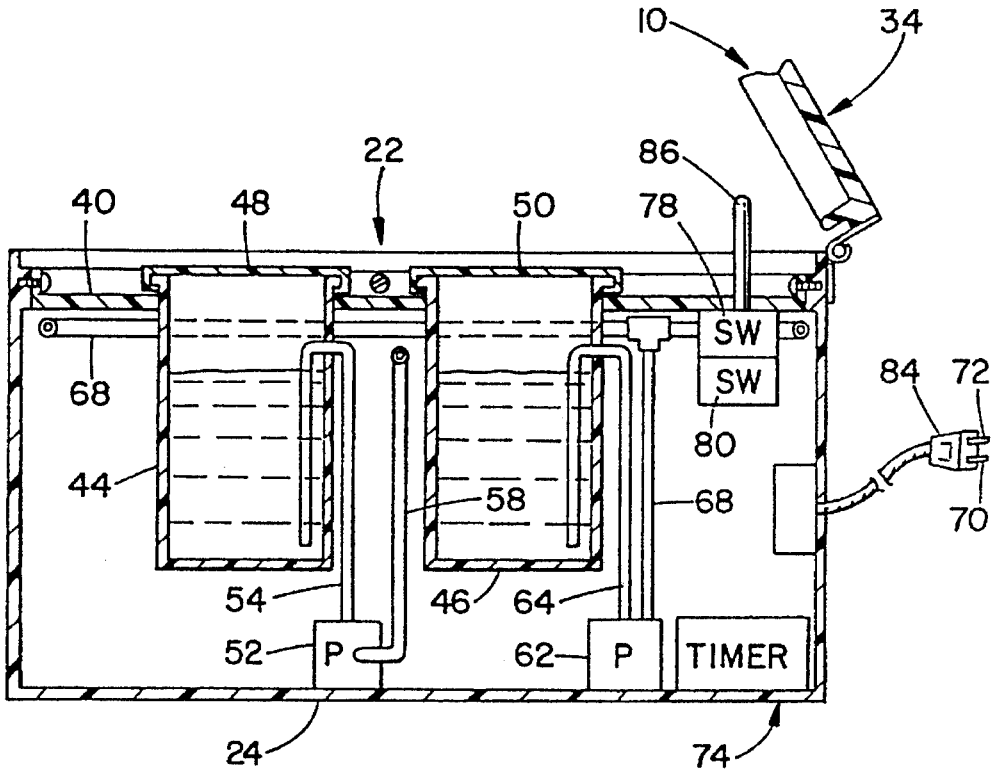
FIG. 3 is a sectional elevation view through the holding and dispensing arrangement for the hamper taken along line 3—3 in FIG. 2.
Figure 4:
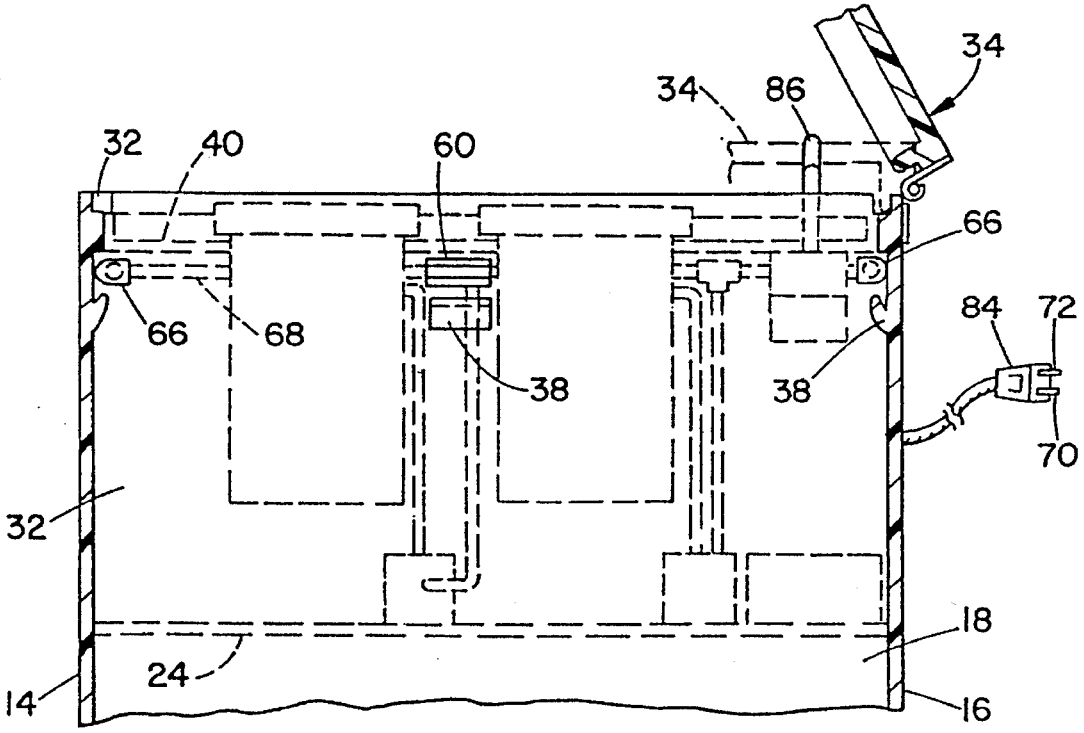
FIG. 4 is a sectional elevation view showing the holding and dispensing arrangement taken along line 4—4 in FIG. 2.

As will become apparent hereinafter, the present invention provides for improved efficiency in cleaning soiled fabrics when laundered in a washing machine designed for such purpose following storage in a moisturized condition for a period of time in a substantially air tight container, such improvement being relative to fabrics having the same soils and aged in air prior to laundering. The tests to be described in detail hereinafter were conducted to determine whether any one of a number of different parameters associated with the method of the present invention is predominant with respect to achieving the improved cleaning efficiency. These parameters include storage time in the sealed container, different liquids used to moisturize the soiled fabrics and the amounts thereof, moisture content of the stored fabrics, the manner of applying liquids thereto and different laundry detergents to moisturize and/or launder the soiled fabrics after storage. It was found, as the tests demonstrate, that cleaning efficiency is improved by storing soiled fabrics in a moisturized condition in a substantially air tight container prior to laundering in a washing machine. It was also found that the highest increase in efficiency resulted from the use of a laundry detergent as the liquid for moisturizing the fabrics, either alone or in combination with other liquids. The storage time in the container does not appreciably affect the increase in efficiency when moisture alone is utilized, but is relevant when laundry detergents are employed. The degree of moisture content of the soiled fabrics as well as the manner of applying liquid to the soiled fabrics are not appreciable parameters.

In conjunction with the tests conducted, twelve hours of air aging was selected as the minimum time that domestic soiled fabrics would air age before either being washed or placed in a hamper for subsequent washing. Accordingly, in all of the tests conducted with respect to hamper storage, 10 the total aging time includes twelve hours of air aging in addition to the designated hamper storage time. In all control tests conducted for comparison purposes with respect to the hamper tests, the soiled fabrics were air aged a minimum of twelve hours. It is assumed that soiled fabrics such as clothes, towels and the like are generally laundered in a home on an average of about every three to four days whereby, as an upper limit, soiled fabrics would be air aged from 72 to 96 hours prior to laundering. Accordingly, certain of the tests described hereinafter provide comparisons in cleaning efficiency between soiled fabrics air aged for such periods of time and air and hamper aged for the same total periods of time. Soiled fabrics for all of the tests were prepared using a 16"×22" piece of white cloth which, unless specified otherwise in conjunction with the tests, was a 65% polyester - 35% cotton blend Monticello manufactured by Cannon Company. Three inch diameter circles were drawn on the fabric pieces, and the soils, which are identified in conjunction with the tests, were applied by brush to completely fill a corresponding circle and allowed to air dry for a period of twelve hours before being used in a hamper test and for a minimum of twelve hours in conjunction with the control tests. In all of the tests, following air aging or air and hamper aging, the soiled fabrics were washed in a Sear's brand Series 100 washing machine set on a 6 minute permanent press cycle, using warm wash/cold rinse water and set to an extra low fill which provided approximately 7.4 gallons of wash water. Soiled fabric to be washed, together with any laundry detergent or other cleaning aid to be used in conjunction with a particular test, were added during the fill cycle and before agitation began. Upon completion of the wash cycle, the cloth was removed from the washing machine and hung to air dry.

Determination of cleaning efficiency was achieved through the use of a device consisting of an enclosed chamber containing a white light source and a silicon solar cell connected to a digital voltage meter. The degree of cleanliness for a given fabric specimen is directly related to the voltage output of the meter. As a standard for cleaning efficiency, an unsoiled piece of white cloth was stretched across a frame and inserted into the chamber such that the solar cell would detect only light reflected off the fabric surface. The device was then adjusted such that a 0.100 volt output corresponded to a perfectly clean piece of cloth representing 100% efficiency. For Tests 1–13 hereinafter described, soil patches for all of the soils to be tested were applied to a cloth and allowed to air dry for 120 hours. These uncleaned soiled patches were analyzed in the chamber and the voltage readings therefor formed the lower limit in determining the percentage of soil removal for each of the ensuing tests. The voltage response of the reflectance measurement was checked and found to be linear such that the voltage difference between the clean cloth standard and a particular soiled patch remained constant regardless of the absolute voltage produced by the clean cloth standard. The voltage output for each sample oscillated +/–0.001 volt around a central value, and the central value was taken as the reflectance reading. For purposes of simplicity, cleaning efficiency is expressed in terms of percentage in the tests described hereinafter, and it will be appreciated that the degree of soil removal is derived from the calculation: $[1-(0.100-VT)/(0.100-VS)]\times 100$; where VT is the test cloth voltage, 0.100 is the clean cloth voltage, and VS is the voltage of the aged, uncleaned soil. For example, a cleaned test cloth which produces a reading of 0.091 volts as opposed to an uncleaned cloth of the same soil which produces a reading of 0.059 volts would be expressed as a cleaning efficiency of 78%.

In all of the tests involving hamper storage, the hamper was provided by a 15 gallon polyethylene garbage container having a removable, air tight lid. To facilitate introducing liquid into the hamper in the form of steam, a small slot was cut in the side of the container near the top thereof to receive the discharge end of a hand-held steamer. The steamer was capable of producing approximately ½ ounce of water vapor in 10 minutes and, when removed from the slit, the latter was sealed against the ingress of air therethrough. In tests wherein liquids were sprayed on soiled fabric in the hamper the liquids were applied by simple trigger sprayer from a plastic bottle. The spray pattern was random with no attempt being made to thoroughly cover a fabric specimen with spray. In those tests where liquid was poured onto the fabric, pouring was in a random pattern.

Liquids used in conducting the tests include commercially available laundry detergents referred to hereinafter as Detergent A and Detergent B, one of which is a commercially available liquid laundry detergent WISK marketed by Lever Brothers having a recommended usage of a 5 ounces per washing machine load, and the other of which is a commercially available powdered laundry detergent TIDE-ULTRA marketed by Proctor and Gamble having a recommended usage of 4 ounces per load. Usage of the latter in liquid form in connection with moisturizing fabrics stored in the hamper was achieved by preparing a slurry of the powder with water. The purpose of the tests disclosed herein is not to compare the relative cleaning efficiencies of Detergents A and B but, rather, to establish as the tests clearly do, that the cleaning efficiency of each detergent is improved in accordance with the present invention. Other liquids used in conjunction with the tests include a chlorine bleach Clorox marketed by Clorox Company having a recommended usage of 8 ounces per load, a liquid laundry pre-spotter Shout marketed by S. C. Johnson and designed to be used immediately before laundering, water, and a 1.5% solution of hydrogen peroxide by volume in water.

In the following tests, each test cloth was provided with 8 soils in separate 3" circles thereon, which soils were applied as described above and consisted of grass stain, mustard, ketchup, lipstick, instant coffee, crayons, hamburger grease and lubricating oil. The cleaning efficiency set forth in the tests is the average cleaning efficiency with respect to all 8 soils.

Recognizing that the test conditions are artificial compared to regular laundering chores, tests were first conducted to establish a baseline of maximum cleaning efficiency under the conditions of testing using commercially available cleaning products. This was not an attempt to judge the "best" cleaning products, but rather to determine the test performance that might be achieved under the artificial conditions set.

TEST 1: Soiled fabric air aged 12 hours was washed using 5 ounces of detergent A. The cleaning efficiency was 70%.

TEST 2: Soiled fabric air aged 12 hours was washed using 5 ounces of detergent A and 8 ounces of chlorine bleach. The cleaning efficiency was 72%.

TEST 3: Soiled fabric air aged 12 hours was washed with 5 ounces of detergent A and a liquid pre-spotter. The cleaning efficiency was 72%.

TEST 4: Soiled fabric air aged 12 hours was washed using 4 ounces of detergent B. The cleaning efficiency was 83%.

TEST 5: Soiled fabric was air aged for 12 hours was washed using 4 ounces of detergent B and 8 ounces of chlorine bleach. The cleaning efficiency was 88%.

As can be seen, test 5 produced the highest degree of cleaning efficiency and so was chosen as the "maximum" standard of conventional cleaning ability under the test conditions.

Tests were performed to determine cleaning efficiency achieved after an aging period more likely in actual laundering conditions.

TEST 6: Soiled fabric air aged 72 hours was washed with 4 ounces of detergent B and 8 ounces of chlorine bleach. The cleaning efficiency was 64%.

TEST 7: Soiled fabric air aged 72 hours was washed with 5 ounces of detergent A and 4 ounces of hydrogen peroxide solution. The cleaning efficiency was 64%.

These tests demonstrate both that cleaning efficiency decreases upon aging of the soils and that the use of a liquid detergent and hydrogen peroxide solution, which is assumed to be particularly well suited to the present invention, performs equivalently to the "maximum" cleaning efficiency product combination under typical soil aging conditions.

An additional test was conducted to determine the further air aging effect on soils:

TEST 8: Soiled fabric air aged 120 hours was washed with 4 ounces of detergent B and 8 ounces of chlorine bleach. The cleaning efficiency was 61%.

Clearly, cleaning efficiency drops quickly as soils age in air, followed by minimal further decline over extended periods of time.

Tests were conducted to determine the basic effects of allowing soiled cloths to age in contact with cleaning solution within a closed hamper:

TEST 9: Soiled fabric air aged 12 hours was placed in the hamper and treated by pouring 5 ounces of detergent A and 4 ounces of hydrogen peroxide thereon. The hamper was closed and the fabric aged therein for 24 hours after which the fabric was washed without any additional laundry detergent or other laundering aid. The cleaning efficiency was 89%.

TEST 10: Soiled fabric air aged 12 hours was placed in the hamper and treated by pouring 5 ounces of detergent A and 4 ounces of hydrogen peroxide solution thereon. The hamper was closed and the fabric aged therein for 108 hours after which the fabric was washed without any additional laundry detergent or other laundering aid. The cleaning efficiency was 95%.

Clearly, pre-treating with a detergent/bleaching solution improves cleaning efficiency dramatically over a period of 72 hours, followed by minimal additional gains over extended periods. Tests 9 and 10 can be properly recognized as pre-soaks, rather than pre-treatments. The cleaning solutions saturate the soiled fabric during residence in the hamper, leaving free standing liquid.

Tests were conducted to determine what effect the dampening, as opposed to saturating, of soiled cloths confined to a hamper has on cleaning efficiency:

TEST 11: Soiled fabric air aged 12 hours was placed in the hamper and treated by spraying 1 ounce of water thereon. The hamper was closed and the fabric aged therein for 60 hours after which the fabric was washed with 5 ounces of detergent A. The cleaning efficiency was 73%.

TEST 12: Soiled fabric air aged 12 hours was placed in the hamper and treated by spraying 1 ounce of hydrogen peroxide solution thereon. The hamper was closed and the fabric aged therein for 60 hours after which the fabric was washed with 5 ounces of detergent A. The cleaning efficiency was 78%.

TEST 13: Soiled fabric air aged 12 hours was placed in the hamper and treated by steaming 1 ounce of water into the hamper. The hamper was closed and the fabric aged therein for 60 hours after which the fabric was washed with 5 ounces of detergent A. The cleaning efficiency was 85%.

The introduction of 1 ounce of liquid into the hamper, in comparison to 9 ounces as in tests 9 and 10, results in a dampening of the test cloths, as opposed to saturation and the presence of free-standing liquid. Comparing the results of these three tests with that of test 7 clearly demonstrates the primacy of moisturization in obtaining improved cleaning efficiency. The use of hydrogen peroxide solution improves performance marginally over plain water. The use of water vapor rather than water spray further enhances the cleaning efficiency.

The following Tests 14–30 were conducted using either detergent A or detergent B and for the purpose of determining the effect of the percent of moisture in the soiled fabric on cleaning efficiency. Tests 14–17 were conducted with respect to black printing ink as the soil, and Tests 18–30 were conducted with lipstick as the soil. The hamper aged fabrics were weighed before and after hamper aging to determine moisture content. Tests 25–27 were conducted using 100% polyester cloth Ponte Double Knit as the fabric, and Tests 28–30 were conducted using 100% cotton cloth Beachwood Tradewinds as the fabric. In all of the tests, the dimensions of the cloth and the application of the soils thereto was as described at the outset herein. In this series of tests, Tests 14, 18, 21, 25 and 28 are control tests. As in Tests 1–13, soiled fabric to be hamper aged was air aged for 12 hours prior to hamper aging. Cleaning efficiency is expressed in the following tests by direct relation to a perfectly clean cloth. It will be appreciated that an efficiency of 78%, for example, reflects a meter reading of 0.078 volts.

TEST 14: Soiled fabric was air aged for 24 hours and then laundered using 5 ounces of detergent B. Cleaning efficiency was 18.5%.

TEST 15: Soiled fabric was placed in the hamper, the hamper was closed, and the fabric was moistened by steaming 1 ounce of water into the hamper providing the fabric with a moisture content of 37%. The fabric was then aged in the hamper for 12 hours following which the fabric was laundered using 5 ounces of detergent B. The cleaning efficiency was 20%.

TEST 16: Test 15 was repeated with hamper aging increased to 36 hours. The steam provided a moisture content of 22%, and the cleaning efficiency was 20%.

TEST 17: Test 15 was repeated increasing hamper aging to 60 hours. The steam provided a moisture content of 34.7% and the cleaning efficiency was 21%.

The difference in moisture content in Tests 15–17 is believed to be the result of the fact that the steam is introduced into the hamper as opposed to being directly applied to the fabric.

TEST 18: Soiled fabric was air aged for 72 hours and then washed with 5 ounces of detergent B. The cleaning efficiency was 67%.

TEST 19: Soiled fabric was placed in the hamper and moisturized by pouring 1 ounce of tap water thereon providing a moisture content of 53.4%. The hamper was then closed and the fabric was aged in the hamper for 60 hours after which the fabric was laundered using 5 ounces of detergent B. The cleaning efficiency was 69.7%.

TEST 20: Soiled fabric was placed in the hamper and moisturized by pouring 1 ounce of a 10% solution of detergent A onto the fabric, providing a moisture content of 49.7%. The hamper was then closed and the fabric was aged in the hamper for 60 hours after which it was laundered using 4 ounces of detergent B. The cleaning efficiency was 75.5%.

TEST 21: Soiled fabric was air aged for 72 hours and then laundered using 5 ounces of detergent A. The cleaning efficiency was 63.7%.

TEST 22: Soiled fabric was placed in the hamper which was then closed, and the fabric was moisturized by steaming ½ ounce of tap water into the hamper, providing a moisture content of 18%. The fabric was aged in the hamper for 60 hours after which the fabric was laundered using 5 ounces of detergent A. The cleaning efficiency was 64.5%.

TEST 23: Soiled fabric was placed in the hamper and was moisturized by pouring ½ ounce of a 3.5% solution of detergent A thereon, providing a moisture content of 34.6%. The hamper was then closed and the fabric was aged in the hamper for 60 hours after which the fabric was laundered using 5 ounces of detergent A. The cleaning efficiency was 65%.

TEST 24: Soiled fabric was placed in the hamper and moisturized by pouring ¼ ounce of a 3.5% solution of detergent A onto the fabric, providing a moisture content of 10.8%. The hamper was then closed and the fabric was aged in the hamper for 60 hours after which the fabric was laundered using 5 ounces of detergent A. The cleaning efficiency was 65.2%.

TEST 25: Soiled 100% polyester fabric was air aged for 96 hours and thereafter washed with 5 ounces of detergent A. The cleaning efficiency was 57.5%.

TEST 26: Soiled 100% polyester fabric was placed in the hamper which was then closed, and the fabric was moisturized by steaming ½ ounce of water into the hamper, providing a moisture content of 11.9%. The fabric was aged in the hamper for 84 hours and thereafter laundered using 5 ounces of detergent A. The cleaning efficiency was 59%.

TEST 27: Soiled 100% polyester fabric was placed in the hamper and moisturized by pouring ¼ ounce of a 3.5% solution of detergent A thereon, providing a moisture content of 7.1%. The hamper was then closed and the fabric was aged in the hamper for 84 hours and thereafter laundered using 5 ounces of detergent A. The cleaning efficiency was 63%.

TEST 28: Soiled 100% cotton fabric was air aged for 72 hours and then laundered using 5 ounces of detergent A. The cleaning efficiency was 69%.

TEST 29: Soiled 100% cotton fabric was placed in the hamper which was then closed, and the fabric was moisturized by steaming ½ ounce of water into the hamper, providing a moisture content of 20.4%. The fabric was aged in the hamper for 60 hours and thereafter laundered with 5 ounces of detergent A. The cleaning efficiency was 69.7%.

TEST 30: Soiled 100% cotton fabric was placed in the hamper and moisturized by pouring ¼ ounce of a 3.5% solution of detergent A on the fabric, providing a moisture content of 16%. The hamper was then closed and the fabric was aged in the hamper for 60 hours after which the fabric was laundered using 5 ounces of detergent A. The cleaning efficiency was 69%.

In the foregoing tests 14–30, the percent of moisture take-up by the fabrics during hamper aging varied from 7.1% to 53.4% while the cleaning efficiency remained relatively consistent within a range of 59% to 69.7% and without any direct relationship with respect to the moisture range. With the exception of Test 30 wherein cleaning efficiency following hamper aging equaled that resulting from the control Test 28, each of the hamper aging tests provided improved cleaning efficiency with respect to the corresponding control test. These tests further demonstrate that hamper storage of moisturized soiled fabrics according to the invention provides improved cleaning efficiency relative to that achieved when fabrics having the same soils are air aged prior to laundering. Further, the moisture content alone does not appreciably affect the degree of cleaning efficiency nor does the hamper aging time, and the use of laundering detergent as at least part of the moisturizing liquid increases cleaning efficiency relative to the use of water or steam alone as the liquid.

In addition to the foregoing tests wherein the percent of moisture in the soiled fabrics was measured, tests were conducted in which the relative humidity in the hamper was measured. In these tests the polyester-cotton fabric pieces were each soiled in three areas with lipstick and allowed to air age for 12 hours before the hamper tests. In one test, a soiled fabric was placed in the hamper with a few drops of water providing a relative humidity of 94% which remained constant during hamper aging of the fabric for 84 hours. Thereafter, the fabric was laundered using 5 ounces of detergent B, and the average cleaning efficiency for the three stains was 72.3%. In two additional tests following the same procedure but placing different amounts of dehydrated baking soda in the hamper as a desiccant, the relative humidity stabilized and remained constant at 56% in both instances during the 84 hour hamper aging. The average cleaning efficiency upon laundering the soiled fabrics using 5 ounces of detergent B was 71.3% in one case and 72.3% in the other. The difference between these two tests is believed to be the result of variance in soiled fabric preparation and/or washing machine agitation. Other tests were conducted using 1.5% hydrogen peroxide or slurries of detergent B in water in amounts to provide a relative humidity in the hamper between about 64% to 67% which remained constant during the 84 hour hamper aging. The cleaning efficiency upon subsequent laundering using 5 ounces of detergent B averaged 72%.

It will be appreciated from the immediately foregoing tests that, as with the percent moisture tests, a significant difference in relative humidity does not affect cleaning ability.

It will be appreciated that liquids other than those disclosed hereinabove in conjunction with Tests 1–32 can be used to moisturize soiled fabrics for hamper storage in accordance with the invention. In particular in this respect, for example, many chemical reactions and effects with respect to soils on fabrics are time dependent, whereby specialty enzymes that would have time to act effectively during hamper storage to break-down organic soils could be used to achieve benefits therefrom that would not be obtainable by using the enzymes during a wash cycle. Further, reducing agents and/or anti-oxidants could be useful in treating sebum and other soils which would otherwise oxidize and/or polymerize to much more tenacious forms over time. In particular, it will be appreciated that hamper aging of moisturized soiled fabrics in accordance with the invention provides for conditioning of the soil to begin immediately upon moisturizing and to continue over the storage time in that the hamper is sealed air tight to preclude dehydration of the moisture in the fabrics. The liquid for moistening the soiled fabrics can also include selected solvents for specialty applications such as where the soil is ink, paint or the like. Further, anti-microbial agents other than hydrogen peroxide can be used, the latter being preferred because of its ability to provide a color-safe bleaching function.

Still further, other bleaches such as hypochlorite or perborate could be used. The latter is a powder and, as with the powdered detergents or other powdered materials which might be used, the material would be pre-mixed with water or other liquid which would be applied to the fabric such as by pouring or spraying.

Referring now to FIGS. 1–6 of the drawing, there is illustrated an embodiment of a hamper 10 for moisturizing and hamper aging soiled fabrics in accordance with the present invention. Hamper 10 is constructed of any suitable air impervious material, preferably plastic, and has a bottom wall 12, front and back walls 14 and 16, respectively, and opposite side walls 18 and 20. A liquid storage and dispensing unit 22 is provided at the upper end of the hamper laterally outwardly adjacent side wall 18 and includes a bottom wall 24, front and rear walls 26 and 28, respectively, an outer side wall 30 and an inner side wall 32 defined by the upper portion of hamper side wall 18. Front and rear walls 14 and 16 of the hamper, together with front and rear walls 26 and 28 of unit 22 and side walls 20 and 30 provide the hamper with an open upper end having a peripheral edge 32. The hamper is adapted to be closed by a hinged cover 34 having a peripheral edge 36 matingly contoured for air tight sealing engagement with peripheral edge 32 when the cover is closed. Alternatively, edge 32 and/or edge 36 can be provided with a sealing gasket for the latter purpose. Preferably, the interior of front and rear walls 14 and 16 and side walls 18 and 20 are provided adjacent the upper ends thereof with integral supports 38 for removably supporting a laundry bag, not shown, of water-repellent, washable material such as nylon to prevent build-up of residues inside the storage area of the hamper and to serve as a laundry bag for carrying conditioned fabrics to the washing machine.

Liquid storage and dispensing unit 22 further includes a top wall 40 spaced above bottom wall 24 and, preferably, removably supported between walls 26, 28, 30 and 32 such as by means of threaded fasteners 42. Top wall 40 is provided with a pair of apertures, not designated numerically, respectively removably supporting liquid containers 44 and 46 having removable covers 48 and 50, respectively. In the embodiment illustrated, and as will be described in greater detail hereinafter, container 44 is for water, hydrogen peroxide or other liquid to be introduced into the storage portion of the hamper as steam, and container 46 is for a liquid detergent to be sprayed into the storage portion of the hamper. Unit 22 further includes a pump 52 for the liquid in container 44 and having an inlet side in flow communication with the liquid in container 44 through flexible tubing 54. The discharge side of pump 52 is connected to an electrically heated steaming plate 56 by flexible tubing 58, and steaming plate 56 has a discharge nozzle 60 opening through wall 32 so as to discharge steam into the storage area of the hamper. Unit 22 further includes a pump 62 having its inlet side connected to the liquid in container 46 by flexible tubing 64 and having its discharge side connected to spray nozzles 66 through flexible tubing 68. Spray nozzles 66 are suitably supported adjacent the inner sides of front and rear walls 14 and 16 of the hamper adjacent the upper ends thereof and may, for example, be suitably adhesively bonded thereto.

Figure 6:
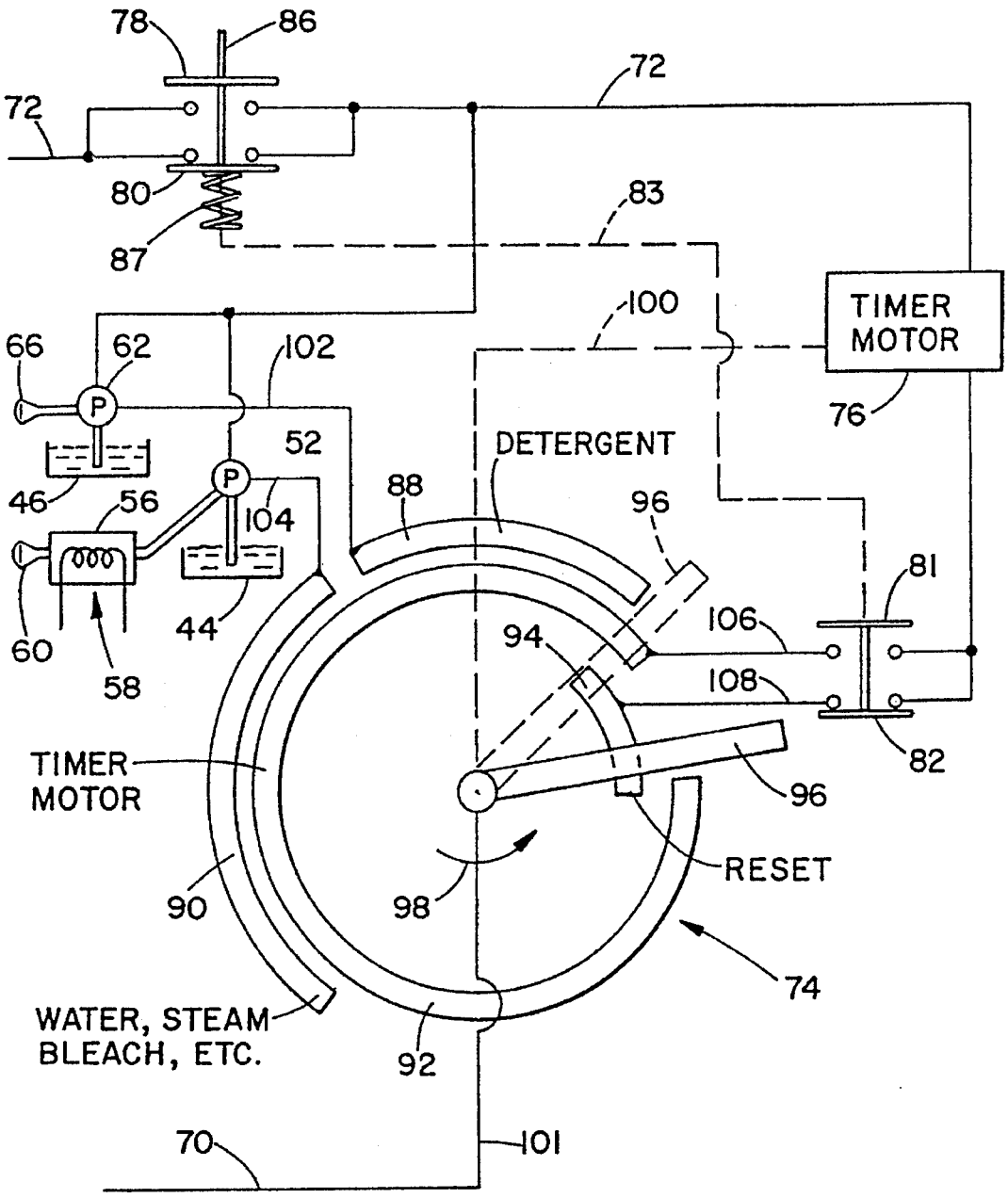

FIG. 6 of the drawings schematically illustrates a control circuit by which the liquid dispensing functions are achieved in the disclosed embodiment. As will be appreciated from the latter Figure, pumps 52 and 62 are connected across power supply lines 70 and 72 through a timer or programmer 74 driven by a timer motor 76 which is connected across lines 70 and 72 respectively through timer 74 and lid switches 78 and 80. For the purpose set forth hereinafter, lid switches 78 and 80 are mechanically interconnected with timer switches 81 and 82 between timer motor 76 and controller 74 as indicated by broken line 83 therebetween. Lines 70 and 72 of the control circuit are adapted to be connected to a 110 volt power source, and for this purpose, and as will be appreciated from FIG. 3, hamper 10 is provided with plug 84 including prongs corresponding to lines 70 and 72. Preferably, lid switches 78 and 80 and timer switches 81 and 82 are actuated in response to closing hamper lid 34 and, for this purpose, switches 78 and 80 are provided with an actuating plunger 86. When plunger 86 is depressed by closing the hamper lid, as indicated by the broken line positions of the lid and plunger in FIG. 4, switches 78 and 81 close against the bias of a spring 87 and switches 80 and 82 open, and when the hamper lid is opened, plunger 86 is released whereby switches 78 and 81 open and switches 80 and 82 close under the bias of spring 87.

Programmer 74 includes arcuate contact strips 88, 90, 92 and 94 respectively operable as described hereinafter to control the time pump 62 is energized and thus the quantity of liquid detergent sprayed into the hamper, the time pump 52 is energized and thus the quantity of water, bleach or other liquid steamed into the hamper, operation of timer motor 76 through the dispensing functions, and resetting of the timer motor after a cycle of operation thereof. Programmer 74 further includes a contact arm 96 adapted to rotate in the direction of arrow 98 to sweep the arcuate contacts. Arm 96 is driven by timer motor 76 through a mechanical connection therewith which is indicated by broken line 100, and the radially inner end of arm 96 is electrically connected to line 70 by line 101. One end of strip 88 is electrically connected to pump 62 by line 102, one end of strip 90 is connected to pump 52 by line 104, one end of strip 92 is connected to power line 72 through line 106, switch 81, timer motor 76 and switch 78, and one end of strip 94 is connected to power line 72 through switch 82, timer motor 76 and switch 80.

In operation, assuming that the hamper lid has been opened to receive soiled fabrics, the component parts of the control circuit are in the positions shown in FIG. 6, including the solid line position of arm 96, whereby switch 80 is closed, switch 78 is open, switch 82 is closed and switch 81 is open. Arm 96 in the solid line position shown in FIG. 6 is in engagement with strip 94, whereby timer motor 76 is energized across lines 72 and 70 through switch 80, switch 82, contact strip 94, arm 96 and line 101. Thus, timer motor 76 operates to displace arm 96 counterclockwise to the broken line position thereof shown in FIG. 6, whereupon timer motor 76 is deenergized by the displacement of arm 96 from strip 94. When the hamper lid is subsequently closed, plunger 86 closes switch 78 and opens switch 80, and mechanical connection 83 closes switch 81 and opens switch 82. Accordingly, timer motor 76 is connected across lines 72 and 70 through switch 78, switch 81, line 106, contact strip 92, arm 96 which is now in the broken line position thereof, and line 101. Accordingly, timer motor 76 rotates arm 96 counterclockwise bringing the outer end thereof into engagement with strip 88 whereupon pump 62 is actuated to pump liquid detergent from container 46 to nozzles 66 for a period of time determined by the arcuate length of strip 88. Continued rotation of arm 96 then brings the latter into engagement with strip 90, whereby pump 52 is actuated to dispense liquid from container 44 across steam plate 56 and nozzle 60 for a period of time determined by the arcuate length of strip 90. While not shown, it will be appreciated that stream plate heating element 58 is connected across lines 72 and 70 through strip 90 so as to be energized during the latter dispensing operation. Timer motor 76 continues to rotate arm 96 through engagement of the latter with strip 92 until such time as arm 96 returns to the solid line position thereof shown in FIG. 6. At this time, switch 82 is open and timer motor 76 is deenergized until such time as the hamper lid is again opened to release plunger 86 whereupon spring 87 biases switches 78 and 81 to open and switches 80 and 82 to close to again reposition contact arm 96 in the broken line position thereof shown in FIG. 6 as described above in preparation for the next cycle of operation.

Although apparatus of the foregoing character is preferred, it will be appreciated that the method of the present invention can readily be practiced simply by providing an air tight container and spraying or pouring liquid thereinto each time a quantity of solid fabrics is placed in the apparatus. Likewise, it will be appreciated that many changes can be made in the preferred apparatus while still providing for the latter to perform the method of the present invention. Particularly in this respect, it will be appreciated that a receptacle for liquid can be supported in the manner shown and provided with a mechanical pump having a stem similar to that used in connection with hand held spraying containers. In such a modification, the stem would be engaged by the cover of the hamper during closure thereof to depress the plunger and thus dispense a spray of liquid into the hamper. Further, in the embodiment disclosed it will be obvious that plunger 86 can be manually depressed and held to provide the liquid dispensing functions before lid 34 is closed. These and other modifications of the embodiment disclosed herein will be obvious or suggested therefrom, whereby it is to be distinctly understood that the foregoing descriptive matter is to be interpreted merely as illustrative of the present invention and not as a limitation.

Having thus described the invention it is claimed:

1. A hamper for pre-treating and storing soiled fabric articles prior to laundering thereof comprising, a container for receiving soiled fabric articles and having a bottom, side wall means extending upwardly from said bottom and having peripheral upper edge means providing said container with an open upper end, cover means for sealing said upper end against the ingress of air into said container, and dispensing means on said side wall means adjacent said open upper end, said dispensing means including receptacle means for storing a pre-treating liquid to be dispensed onto soiled fabric articles in said container, nozzle means for directing said pre-treating liquid from said receptacle means into said container adjacent said open upper end thereof, cyclically operable pump means for pumping a predetermined amount of said liquid from said receptacle means to said nozzle means during a cycle of operation thereof, and means to actuate said pump to operate through a cycle.

2. A hamper according to claim 1, wherein said cover means and said peripheral upper edge means interengage to seal the interior of said container when said cover means closes said open upper end.

3. A hamper according to claim 1, wherein said means to actuate said pump means includes said cover means.

4. A hamper according to claim 1, wherein said dispensing means includes means to heat said liquid.

5. A hamper according to claim 1, wherein said receptacle means includes first and second receptacles for first and second different liquids, and said pump means includes first and second pumps respectively for pumping said first and second liquids from said first and second receptacles.

6. A hamper according to claim 5, wherein said nozzle means includes first and second nozzles for respectively directing said first and second liquids into said container.

7. A hamper according to claim 1, wherein said dispensing means includes timing means to time the length of said cycle of operation of said pump means.

8. A hamper according to claim 1, wherein said container includes means on said side wall means adjacent said open upper end for removably supporting liner means for said container.

9. A hamper according to claim 1, wherein said cover means is pivotally interconnected with said container at said peripheral upper edge means.

10. A hamper according to claim 9, wherein said means to actuate said pump means includes said cover means.

11. A hamper according to claim 10, wherein said dispensing means includes means to heat said liquid.

12. A hamper according to claim 11, wherein said receptacle means includes first and second receptacles for first and second different liquids, and said pump means includes first and second pumps respectively for pumping said first and second liquids from said first and second receptacles.

13. A hamper according to claim 12, wherein said nozzle means includes first and second nozzles for respectively directing said first and second liquids into said container.

14. A hamper for pre-treating and storing soiled fabric articles prior to laundering thereof comprising, a container for receiving soiled fabric articles and having bottom and top ends and side wall means therebetween, means providing said container with an opening thereinto, cover means for sealing said opening against the ingress of air into said container, and dispensing means on said container adjacent said top and, said dispensing means including receptacle means for storing a pre-treating liquid to be dispensed onto soiled fabric articles in said container, nozzle means for directing said pre-treating liquid from said receptacle means into said container adjacent said top end thereof, pump means for pumping a predetermined amount of said liquid from said receptacle means to said nozzle menas, and means to actuate said pump means.

15. A hamper according to claim 14, wherein said means to actuate said pump means includes said cover means.

16. A hamper according to claim 14, wherein said dispensing means includes means to heat said liquid.

17. A hamper according to claim 14, wherein said receptacle means includes first and second receptacles for first and second different liquids, and said pump means includes first and second pumps respectively for pumping said first and second liquids from said first and second receptacles.

18. A hamper according to claim 17, wherein said nozzle means includes first and second nozzles for respectively directing said first and second liquids into said container.

19. A hamper according to claim 14, wherein said pump means is cyclically operable and said dispensing means includes timing means to time the length of said cycle of operation of said pump means.

* * * * *